US008387403B2

(12) United States Patent
Weiss

(10) Patent No.: US 8,387,403 B2
(45) Date of Patent: Mar. 5, 2013

(54) GOODS PRESENTATION REFRIGERATOR WITH AIR FLOW PROVISIONS FOR PREVENTING CONDENSATION ON DOOR

(76) Inventor: Albert Weiss, Osterburken (DE)

( * ) Notice: Subject to any disclaimer, the term of this patent is extended or adjusted under 35 U.S.C. 154(b) by 778 days.

(21) Appl. No.: 12/201,096

(22) Filed: Aug. 29, 2008

(65) Prior Publication Data

US 2009/0064691 A1 Mar. 12, 2009

(30) Foreign Application Priority Data

Aug. 31, 2007 (DE) ..... 10 2007 041 453

(51) Int. Cl.
*F25D 25/00* (2006.01)
*A47F 3/04* (2006.01)

(52) U.S. Cl. ..... 62/62; 62/248; 62/255; 62/251

(58) Field of Classification Search ..... 62/62, 248, 62/251, 255, 95, 93
See application file for complete search history.

(56) References Cited

U.S. PATENT DOCUMENTS

| | | | | |
|---|---|---|---|---|
| 2,013,264 | A | 9/1935 | Buder | |
| 2,247,736 | A | 7/1941 | Tull | |
| 2,463,686 | A * | 3/1949 | Giffard | 62/377 |
| 3,200,957 | A * | 8/1965 | Morin | 211/1 |
| 4,466,254 | A | 8/1984 | Karashima | |
| 2006/0207279 | A1 * | 9/2006 | Daddis et al. | 62/255 |

FOREIGN PATENT DOCUMENTS

| | | | |
|---|---|---|---|
| DE | 1 897 942 | | 8/1964 |
| DE | 43 32 773 | A1 | 3/1995 |
| EP | 1 772 689 | | 4/2007 |
| FR | 2633376 | | 12/1989 |
| JP | 06307754 | * | 11/1994 |

OTHER PUBLICATIONS

German Patent Office Search Report, Jul. 22, 2008.
German Patent Office Search Report, Aug. 31, 2011, English translation provided.

* cited by examiner

*Primary Examiner* — Frantz Jules
*Assistant Examiner* — Cassey D Bauer
(74) *Attorney, Agent, or Firm* — Dority & Manning, P.A.

(57) ABSTRACT

A cooling goods presentation refrigerator for presenting refrigerated goods or frozen goods has a vertical access opening to the goods chamber that is subdivided into vertically superposed compartments. The current of cooling air is conducted out of the head part directly into the shelf compartments arranged underneath it, during which the cooling air flows from the top downward through one shelf compartment after the other. From the lowest shelf compartment, the air is trapped in a collection chamber arranged underneath it and subsequently prepared by the cooling unit for the next circulation. The head part of the goods presentation refrigerator includes an air-permeable separating wall against the adjacent shelf compartment. The shelf compartment bottoms are air-permeable, so that the current of cooling air can flow successively downward through the shelf compartments.

5 Claims, 3 Drawing Sheets

GOODS PRESENTATION REFRIGERATOR WITH AIR FLOW PROVISIONS FOR PREVENTING CONDENSATION ON DOOR

FIELD OF THE INVENTION

The invention relates to a goods presentation refrigerator for presenting refrigerated goods or frozen goods, with a vertical access opening to the goods chamber, that is subdivided into vertically superposed compartments.

BACKGROUND

A goods or merchandise presentation refrigerator is known, for example, from DE 10 2005 047 813 A1. Intermediate walls are provided for the conduction of refrigerating air that are manufactured from sheeting or a frame covered with fabric. Thus, for example, an intermediate wall is provided on the inside of the refrigerator as a delimitation of the cold air flow against the goods chamber which wall is arranged at a distance of approximately 3 to 5 cm in front of the actual back wall of the refrigerator. The conduit over the entire back side and the cover of the refrigerator formed as a result serves to conduct the cold air that is produced in the lower part of the refrigerator and is blown by ventilators into the head part of the refrigerator. The cold air flows out on the front edge of this head part into the goods chamber of the refrigerator. The downwardly dropping cold air is removed by suction on the front edge of the lower part of the refrigerator, supplied to the refrigerating unit and removed from this refrigerating unit by a blower and blown upward into the conduit between the rear wall of the refrigerator and the intermediate wall, so that the circuit is closed. These so-called air guide sheets are usually also provided with perforations that support the distribution of cold air in the refrigerator. These perforations differ from refrigerator type to refrigerator type and are tested in practice and subsequently set.

These goods presentation refrigerators are typically open on their front side in order to give customers free access and also to make it possible for them to see the presented goods. In order to nevertheless ensure a good cooling, the goods chamber is closed against the surrounding sales room by a current of cooling air (cooling air veil) (as discussed in DE 43 32 773 C2). However, this arrangement requires a high cooling output and is therefore uneconomical. Goods presentation refrigerators of this type are therefore to be closed as a rule with roller blinds for the night and to prevent cooling losses at least outside of the sales times. Furthermore, goods presentation refrigerators are known that are provided with glass doors that can be pivoted or also can slide and therefore can also be used as iceboxes. However, it turned out that the glass doors become covered with moisture due to the current of cooling air. Even a formation of ice can occur by the freezing of condensate that precipitates on the panes. This hinders the observation of the goods by the customer. In addition, the panes must be wiped again and again The invention has the problem of avoiding these disadvantages and of preventing a sweating of the door panes.

SUMMARY

Additional objects and advantages of the invention will be set forth in part in the following description, or may be obvious from the description, or may be learned through practice of the invention.

The invention is based on the recognition that the closing of the goods chamber of the shelves with glass doors causes the customary flow of cooling air to become disadvantageous and ineffective. A better utilization of the current of cooling air takes place by a direct guidance of the current of cooling air through the shelf compartments as well as by the direct contact of the goods with the current of cooling air. The problem of the precipitation of condensate on the door panes is solved in this manner.

According to certain embodiments, the air veil customary on the front side is eliminated and therewith also a precipitation of condensate on the door panes. Since the entire shelf compartment is exposed to the current of cooling air passing through it, the cooling is extremely effective and the air flow can be held to low rates. This produces fewer vortexing losses. The correct distance of the cooling air flow from the door panes ensures that the panes do not sweat or even ice over.

According to a particular embodiment, the compartments are separated from each other by air-permeable separating walls or shelf compartment bottoms. This ensures the passage of the cooling air current through all compartments in succession, even when the shelf bottoms are covered with goods. The shelf bottoms are perforated over their entire surface for a uniform flowthrough of the compartments; however, the perforation ends at a distance in front of the glass panes of the doors, so that the cooling air current does not contact them and a formation of condensate on them is prevented. The collection chamber under the bottom of the lowest shelf compartment, as well as the end of the perforation of the lowest shelf bottom at a fairly large distance from the door panes, prevent a buildup of cold air in front of the lower door area and a formation of condensate there. The customary goods dividers have passages for the cooling air current that are coordinated with the grid of the perforation of the shelf compartment bottoms. This ensures a good flowthrough with cooling air in spite of the stored goods. The flow of cooling air in accordance with the invention makes possible a good utilization of space and flexibility in the division of the goods cooling chamber.

Further details of the invention are described using the drawings.

DESCRIPTION

Figure 1:
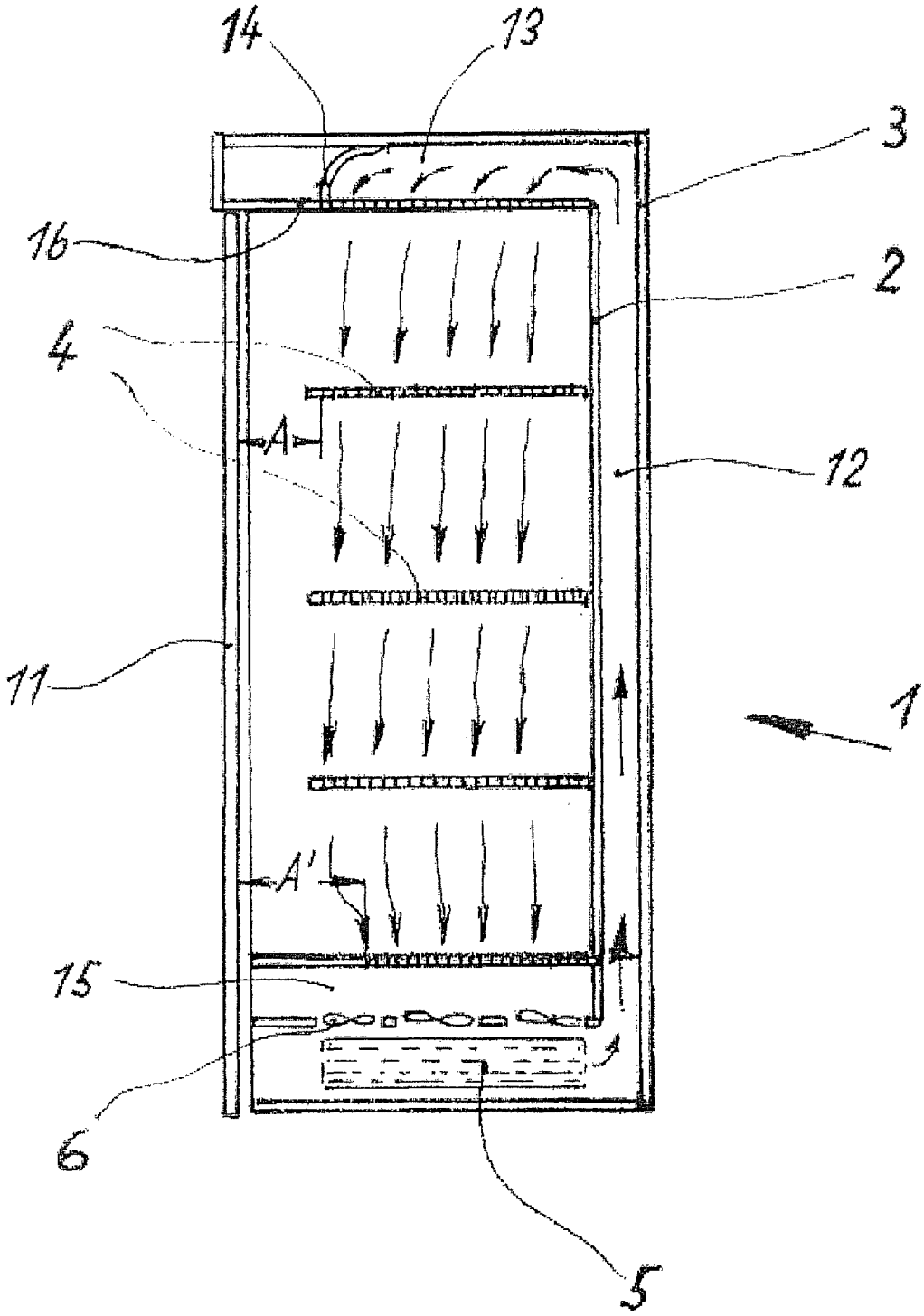
FIG. 1 shows the construction of the goods presentation refrigerator in accordance with the invention in a schematic view.
Figure 2:
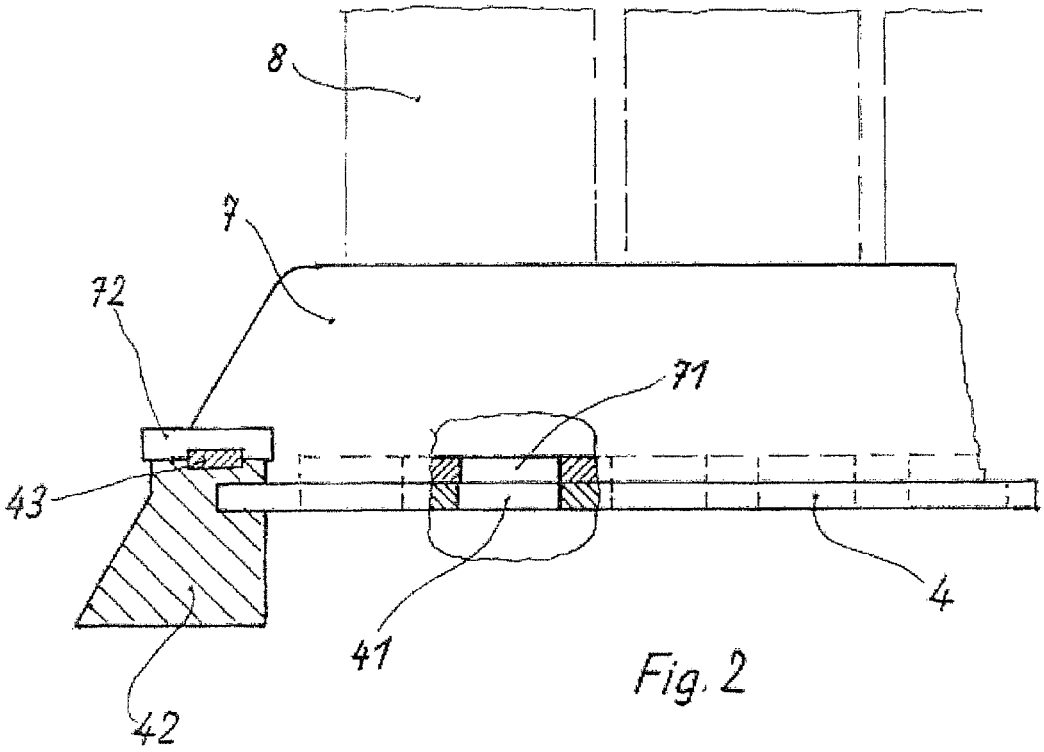
FIG. 2 shows the arrangement of the goods dividers on the shelf bottom.
Figure 3:
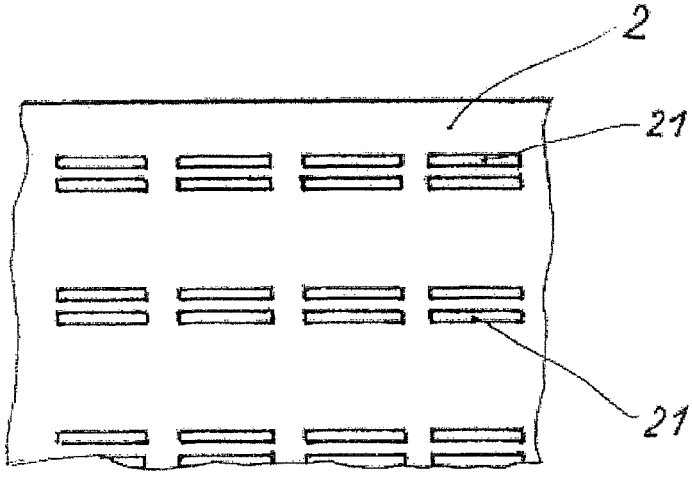
FIG. 3 shows the intermediate wall with stamped-in perforations.
Figure 4:
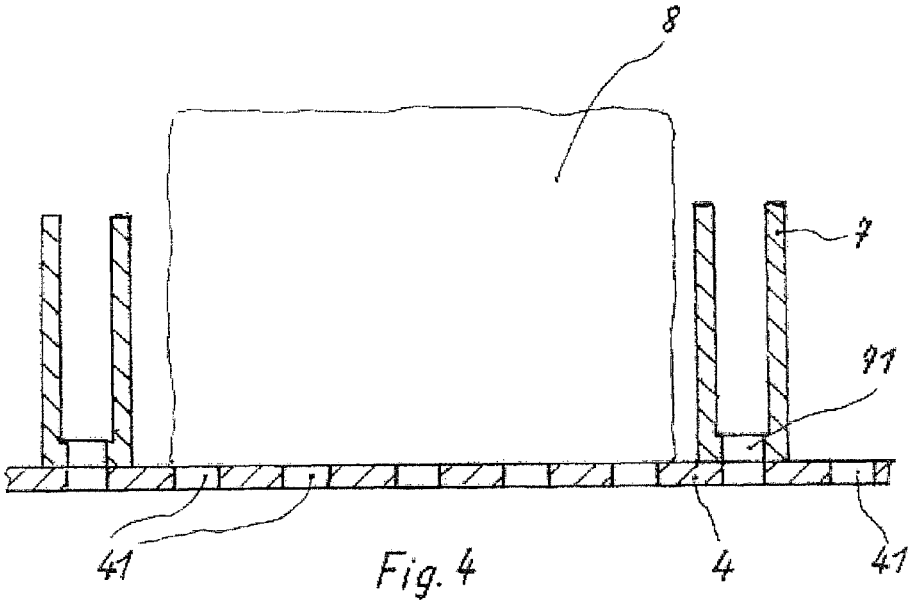
FIG. 4 shows a shelf bottom with goods dividers in section.
Figure 5:
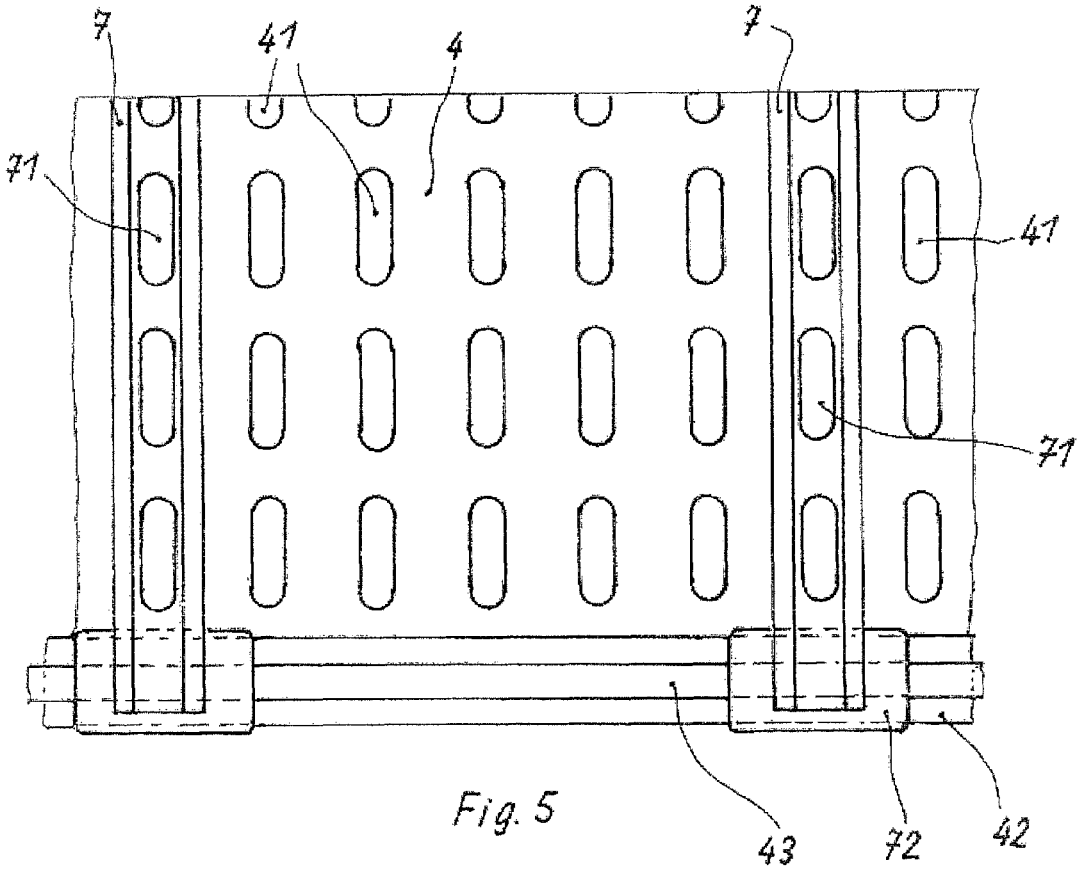
FIG. 5 shows the front-end of a shelf bottom in a top view.

Reference will now be made to embodiments of the invention, one or more examples of which are illustrated in the drawings. Each embodiment is presented by way of explanation of the invention, and not as a limitation of the invention. For example, features illustrated or described as part of one embodiment may be used with another embodiment to yield still a further embodiment. It is intended that the invention include these and other modifications and variations of the embodiments described herein.

In a particular embodiment, goods presentation refrigerator 1 consists of a housing that comprises a rear wall 3 and doors 11 on its front side. Doors 11 are transparent over a large surface and therefore consist to great extent of glass panes that allow an open view of the entire goods chamber. The goods chamber is subdivided into individual shelf compartments by intermediate bottoms 4 adjustably fastened laterally or on the rear wall. The cooling unit 5 with ventilators is arranged in the lower part of refrigerator 1. The shelf compartments with shelf bottoms 4 are limited on their rear side by an intermediate wall 2. As a result, an air conduit 12 is formed between this intermediate wall 2 and rear wall 3 of refrigerator 1 which empties into a head part 13 arranged above the shelf compartments, which part 13 is delimited against the uppermost shelf compartment by a horizontally arranged separation wall 16. This separating wall 16 is air-permeable over its entire surface. A distance A to doors 11 is maintained, as in the case of shelf bottoms 4. This area is not air-permeable. The cooling air current is conducted by air guide sheet 14 against the air-permeable surface of separating wall 16. This surface is preferably perforated like shelf bottoms 4, although the perforation can absolutely be different. This is a function of the desired amount of air to be let through.

A current of air is produced by ventilators 6 that draws the air out of the goods chamber and presses it through cooling unit 5, in which the air is cooled down and pressed upward through conduit 12 into head part 13. From there, the current of cooling air is distributed by separating wall 16 onto the uppermost shelf compartment, from which it flows from the top down through one shelf compartment after the other. In the lowest shelf compartment, the current of cooling air is drawn off by suction through shelf bottom 4 by ventilators 6 into a collection chamber 15 and supplied to cooling unit 5 to be prepared for the next circulation.

It is essential for the flowthrough of the individual compartments that the individual shelf bottoms 4 are air-permeable. They are therefore provided with a perforation 41. In the described exemplary embodiments, shelf bottoms 4 consist of a perforated sheet that mates on its free end into a carrier strip 42 and is stiffened by it. However, even other constructions are possible for the shelf bottoms such as grid rods, fabric, wire mesh etc. This carrier strip 42 is advantageously constructed in such a manner that it can be used at the same time for holding display signs for prices and goods. A guide rail 43 is fastened on this carrier strip 42 along which rail goods dividers 7 can be shifted.

In order to be able to arrange the displayed goods, it is customary to use so-called goods dividers. Here, however, goods dividers 7 still have to fill a special task: They must position goods 8 in such a manner that the flow of cooling air can flow through shelf bottom 4 into the particular next shelf compartment. These goods dividers therefore have air passage openings 71 designed to be congruent with the perforation grid of shelf bottom 4. Goods dividers 7 have double walls and thus keep air passage openings 71 free of goods packages 8. Goods dividers 7 are mounted on a guide shoe 72 and can be pushed with it on guide rail 43 into different positions, depending on which space is required in the shelf compartment for an assortment of goods. Since air passage openings 71 are congruent with perforation holes 41 of shelf bottom 4, it is ensured that the current of cooling air can always flow into the next shelf compartment in the various positions of goods dividers 7.

As already mentioned above, shelf bottoms 4 are perforated over their entire surface, but the perforation ends at a distance A in front of the glass panes of door 11. This distance A is selected to be so great that no condensate precipitates on the panes of doors 11. The current of cooling air flowing through the shelf compartment therefore does not come inadmissibly close to the panes of door 11. Due to the large-area distribution of the current of cooling air over the surface of shelf bottom 4, its speed is low and it has only slight turbulences. This favors keeping the flow of cooling air away from door panes 11 and prevents sweating. It proved to be advantageous to provide a distance A' for the perforation of the lowest shelf bottom that is greater than the distance A of the perforation of the other shelf bottoms 4. This avoids a backup of cold air in this lower area.

These distances A and A' are a function of the size of the goods chamber and of the number of shelf compartments and of the cooling output which the current of cooling air must achieve. The distances A and A' are therefore determined by experiments. The direct flow of air in full width through the compartments significantly reduces the energy requirement as regards the amount of air to be circulated as well as the cooling output. Turbulences are widely avoided by the low air speeds.

It should be appreciated by those skilled in the art that modifications and variations can be made to the embodiments described herein without departing from the scope of the appended claims.

The invention claimed is:

1. A refrigerator configured for presenting refrigerated or frozen goods, comprising:

an internal goods chamber having a vertical access opening closed by a door, said goods chamber subdivided into vertically stacked shelf compartments;

a head part disposed within said goods chamber above said shelf compartments, a cooling unit within said goods chamber below said shelf components, and a conduit within said goods chamber that transports a flow of cooling air from said cooling unit to said head part;

said head part further comprising an air-permeable separating wall adjacent the uppermost said shelf compartment;

each of said shelf compartments further comprising an air permeable bottom defining a plurality of perforations;

wherein a recirculating cooling air flow is directed from said head part, through said air-permeable separating wall, successively downward through said air permeable bottom of each said shelf compartment, to said cooling unit, and into said conduit; and wherein a lowest one of said shelf compartment bottoms that is disposed closest to said cooling unit extends to said doors and has a portion set back a distance "A'" from said doors that is not air permeable, with the remaining portion defining perforations over substantially the entire surface thereof, wherein each end of said perforation that is nearest said doors of each other said shelf compartment other than said lowest one of said shelf compartment bottoms is set back a distance A from said doors and said set back distance A' for said lowest said shelf compartment is greater than said set back distance A for said other shelf compartments.

2. The refrigeration as in claim 1, further comprising a collection area between said cooling unit and the lowest said shelf compartment, the collection area being disposed so that cool air passing through the lowest said shelf compartment being drawn by suction into said cooling unit.

3. The refrigerator as in claim 1, further comprising upright goods dividers arranged on said shelf compartments, said goods dividers being open to airflow in a vertical direction therethrough so as not to inhibit cooling airflow through said shelf compartments.

4. The refrigerator as in claim 3, wherein said goods dividers comprise internal vertically oriented passages that align with openings or perforations in said shelf compartment bottoms.

5. The refrigerator as in claim 4, wherein said goods dividers are adjustable on said shelf compartment bottoms.

* * * * *